US008443869B2

(12) United States Patent
Lavanchy et al.

(10) Patent No.: US 8,443,869 B2
(45) Date of Patent: May 21, 2013

(54) CONDENSER-TYPE WELDED-PLATE HEAT EXCHANGER

(75) Inventors: Michel Lavanchy, St. Martin D'uriage (FR); Jean-Pierre Concolato, Vif (FR); Claude Roussel, Echirolles (FR)

(73) Assignee: Alfa Laval Vicarb, Fontanil Cornillon (FR)

( * ) Notice: Subject to any disclaimer, the term of this patent is extended or adjusted under 35 U.S.C. 154(b) by 1543 days.

(21) Appl. No.: 11/916,035

(22) PCT Filed: Jun. 23, 2006

(86) PCT No.: PCT/FR2006/050623

§ 371 (c)(1),
(2), (4) Date: Nov. 30, 2007

(87) PCT Pub. No.: WO2007/003838

PCT Pub. Date: Jan. 11, 2007

(65) Prior Publication Data

US 2008/0196871 A1 Aug. 21, 2008

(30) Foreign Application Priority Data

Jun. 29, 2005 (FR) ..... 05 51814

(51) Int. Cl.
*F28F 9/22* (2006.01)

(52) U.S. Cl.
USPC ..... 165/82; 165/83; 165/145

(58) Field of Classification Search
USPC ..... 165/81–82, 140, 145, 83
See application file for complete search history.

(56) References Cited

U.S. PATENT DOCUMENTS

| | | | | | |
|---|---|---|---|---|---|
| 1,658,063 | A | * | 2/1928 | Stancliffe | 165/140 |
| 2,340,138 | A | * | 1/1944 | Morris | 165/140 |
| 2,439,208 | A | * | 4/1948 | Gloyer | 165/140 |
| 2,469,028 | A | * | 5/1949 | Belaieff | 165/140 |
| 2,566,310 | A | * | 9/1951 | Burns et al. | 165/140 |
| 3,233,664 | A | * | 2/1966 | Jacobs | 165/145 |
| 3,305,008 | A | * | 2/1967 | Jacobs | 165/145 |
| 3,525,390 | A | * | 8/1970 | Rothman | 165/140 |
| 4,453,592 | A | * | 6/1984 | Wightman | 165/82 |
| 4,466,482 | A | * | 8/1984 | Dorazio et al. | 165/145 |
| 4,719,970 | A | | 1/1988 | Fayolle | |
| 5,755,280 | A | * | 5/1998 | da Costa et al. | 165/140 |

(Continued)

FOREIGN PATENT DOCUMENTS

| | | |
|---|---|---|
| DE | 10 82 606 B | 6/1960 |
| DE | 14 51 131 B1 | 7/1970 |

(Continued)

OTHER PUBLICATIONS

International search report for PCT/FR2006/050623.

*Primary Examiner* — Leonard R Leo
(74) *Attorney, Agent, or Firm* — Heslin Rothenberg Farley & Mesiti P.C.

(57) ABSTRACT

A condenser-type heat exchanger having a set of welded plates that together define fluid systems that interpenetrate each other, comprises at least two modules of welded plates. Each module presenting an independent cooling system ($CF_1$, $CF_2$), fluid ($CF_2$) being preferably colder than fluid ($CF_1$), and a connecting chamber that connects the two modules in series in the system of fluid to be condensed such that the direction in which the fluid to be condensed flows is reversed when it changes from one module to the next module.

8 Claims, 3 Drawing Sheets

U.S. PATENT DOCUMENTS

| | | | | | |
|---|---|---|---|---|---|
| 5,893,411 | A | * | 4/1999 | Nir | 165/140 |
| 5,927,387 | A | * | 7/1999 | Nystrom | 165/145 |
| 5,996,356 | A | * | 12/1999 | Kishimoto et al. | 165/140 |
| 6,089,313 | A | * | 7/2000 | Levy et al. | 165/145 |
| 6,158,238 | A | * | 12/2000 | Lampinen et al. | 165/140 |
| 6,516,873 | B1 | * | 2/2003 | Haugen | 165/145 |
| 6,729,387 | B2 | * | 5/2004 | Replogle et al. | 165/140 |
| 7,004,237 | B2 | * | 2/2006 | Mathur et al. | 165/82 |
| 2004/0159424 | A1 | * | 8/2004 | Reinke et al. | 165/140 |
| 2007/0125527 | A1 | * | 6/2007 | Flik et al. | 165/140 |

FOREIGN PATENT DOCUMENTS

| | | | | |
|---|---|---|---|---|
| DE | 31 14 948 | A1 | | 1/1983 |
| DE | 3151867 | C1 | * | 5/1983 |
| EP | 0 801 281 | A | | 10/1997 |
| WO | WO 2004113815 | A1 | * | 12/2004 |

* cited by examiner

CONDENSER-TYPE WELDED-PLATE HEAT EXCHANGER

CROSS REFERENCE TO RELATED APPLICATIONS

This application is a national stage filing under section 371 of International Application No. PCT/FR2006/050623, filed on Jun. 23, 2006, and published in French on Jan. 11, 2007, as WO 2007/003838 and claims priority of French application No. 0551814 filed on Jun. 29, 2005, the entire disclosure of these applications being hereby incorporated herein by reference.

FIELD OF THE INVENTION

The invention relates to the field of heat exchangers, particularly exchangers used as condensers.

It relates in particular to plate exchangers belonging to the family of welded-plate exchangers as opposed to plate exchangers produced by assembling plates together separated by peripheral seals.

Welded-plate exchangers are more robust in design in that they consist exclusively of metal parts and do not include any compressible leaktight seals made of elastomer or similar materials. This design of welded-plate exchangers therefore makes them compatible with the treatment of an extremely wide range of fluids, particularly fluids that are harmful to elastomer materials. In particular the application of solvent treatments may be referred to.

The invention therefore relates more specifically to a new heat exchanger structure used as a condenser.

PRIOR ART

Welded-plate exchangers can generally be used in applications aimed at ensuring vapour condensation. The principle of such condensers consists in putting vapour loaded with condensable matter into contact with a cold source.

In welded-plate exchangers, the various plates define fluid systems that interpenetrate each other.

In the field of condensers, various solutions have already been proposed to improve the efficiency of a simple condenser. It is important to eliminate the maximum condensable matter from the vapour phase when it passes through the condenser in order to limit discharge into the atmosphere and prevent too much condensed suspended matter from penetrating the components downstream of the condenser and risk damaging them.

Therefore, the first solution consists in combining two single condensers in series thereby ensuring two successive condensation phases. More precisely, in the first condenser the fluid to be condensed flows in a descending flow which enables part of the liquid contained in the vapour to be separated. The liquid condensing inside the condenser drains naturally which therefore enables the first part of the condensates to be collected. The vapour containing a non-condensed fraction and a certain quantity of suspended droplets is then directed towards a second condenser. The second condenser generally has ascending circulation for the vapour and descending circulation for the condensates and, for this reason, is known as a reflux condenser. An additional apparatus called a mist eliminator, which may or may not be included in the condenser, is needed to eliminate the suspended droplets in the non-condensable gas when it leaves the second condenser.

Preferably a fluid coolant runs through the second condenser at a lower temperature than that of the coolant in the first condenser such that it improves the efficiency of the treatment.

Another solution has already been proposed consisting in designing condensers with a vapour system that flows in two opposite directions. Therefore this type of condenser, called a double pass condenser, has a first section in which the vapour flow descends, the vapour system being extended by a section in which the flows ascends. In this section the condensate that flows downwards according to the laws of gravity is partly drawn by the ascending flow of the vapour as fine droplets. Similar to the two separate condensers, a mist eliminator apparatus is required in order for the condensation to be efficient. Furthermore, the use of a single coolant lowers the thermal performance of the condenser thus configured.

Several condensers of this type can also be disposed in series in order to achieve improved efficiency and greater elimination of condensable products.

The association of two condensers in series can, however, pose mechanical problems.

Such an assembly requires the two vapour systems in the condensers to be connected to each other, the connections having to bear the mechanical vibrations, thermal shocks and other mechanical stresses observed in treatment installations.

Furthermore, these condenser sets are generally positioned in the upper section of treatment installations and the use of mechanical supports that are sufficiently robust and therefore heavy has proved to be a significant drawback.

The aim of the invention is to provide a condenser that presents excellent performances in terms of condensation efficiency while remaining relatively simple to produce and assemble inside a complete installation.

DISCLOSURE OF THE INVENTION

The invention therefore relates to a condenser-type heat exchanger that comprises in a known way a set of welded plates that together define fluid systems that interpenetrate each other.

According to the invention, the exchanger is characterised in that it comprises at least two modules of welded plates, each module presenting an independent cooling system. The exchanger also comprises a connecting chamber that connects two modules in series on the system of fluid to be condensed such that the direction in which the fluid to be condensed flows is reversed when it changes from one module to the next module.

In other words, the invention consists in performing the condensation operation using a single exchanger but in two stages, i.e. a first stage with condensation occurring on a first plate module with a first coolant. The first condensation is followed by a second stage inside the second module of welded plates through which a coolant can advantageously flow at a lower temperature. The profile of the plates is advantageously designed to ensure mist elimination inside the condenser.

Due to the fact that the two plate modules are in series the fluid to be condensed flows in a descending flow preferably in the first module and ascends in the second. The use of an ascending flow and a coolant at a lower temperature improves the efficiency of the condensation, i.e. reduces the percentage of non-condensed matter in the treated vapour.

The above combination is achieved in a single exchanger which facilitates positioning the exchanger by limiting the infrastructure needed for it to be included in an installation generating the vapour to be condensed.

In practice the connecting chamber can be defined by the space separating the two surfaces of the plate modules located on the same side of the exchanger and the outer walls of the exchanger. In other words, the connecting chamber connects the two inlets of the plate modules that are located on the same side of the exchanger. Therefore in the simplest configuration the vapour to be condensed leaves the first module via the lower surface in a descending flow and penetrates the second module via the lower surface of the latter in a flow which is therefore ascending.

The connecting chamber is defined on the outside by the exchanger frame and the inner surface is defined by a wall that extends between the two plate modules. The wall can consist of a solid intermediary part located between the two plate modules or preferably of a welded plate disposed between the two modules to ensure the leaktightness of the connecting chamber. It is therefore possible to use a uniform material to come into contact with the vapour between the modules and the connecting plate.

Advantageously, in practice the connecting chamber wall is capable of elastic deformation according to the direction between the modules. In other words, the shape of the plate constituting the wall is capable of compensating for the mechanical stresses resulting from the differences in temperature between the two plate modules, for example using expansion bellows.

In practice, and according to the applications required, the volumes of the various plate modules included in the exchanger may be different, particularly according to the composition of the vapour to be condensed.

Therefore in the simplest version of the exchanger with two modules the volume of the first module may be greater than that of the second due to the fact that the quantity of product to be condensed is greater than that in the second module.

In the rest of the description the exchangers according to the invention are presented in a version that includes two welded-plate modules but it goes without saying that it is also possible to increase the number of modules by increasing the number of independent cooling systems and the number of connecting chambers without leaving the scope of the invention.

In an alternative embodiment, the system of fluid to be condensed in each module may comprise two segments in series that are directed in opposite directions. In other words, suitable baffle plates can be used inside each module to organise the system of fluid to be condensed the first section of which has a descending flow followed by a section with an ascending flow. The advantages of a double pass exchanger then become apparent in each module wherein the succession of descending condensation and reflux circulation zones offer increased efficiency in terms of condensation and mist elimination.

BRIEF DESCRIPTION OF THE FIGURES

The method used to achieve the present invention and the resulting advantages will be better understood from the following brief description of the embodiments which refers to the attached figures where.

PREFERRED EMBODIMENTS

Figure 1:
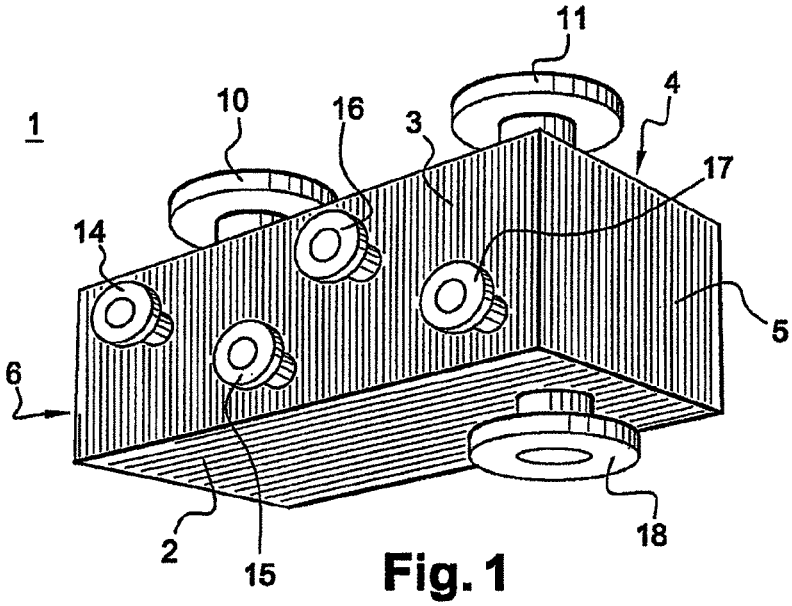
FIG. 1 is a schematic perspective view of an exchanger according to the invention.

As described above, the invention relates to a heat exchanger that can be used mainly in condenser applications. Such an exchanger is shown in FIG. 1 and it is of an overall rectangular box shape defined by a set of outer walls, i.e. a lower wall (2), a frontal wall (3), an upper wall (4), a lateral wall (5, 6) and a back wall (7) seen in FIG. 2.

On upper wall (4) are disposed the inlet (10) and outlet (11) of the fluid including the matter to be condensed.

Frontal wall (3) includes the inlets of both cooling systems. More precisely, as shown in FIG. 1, frontal wall (3) comprises inlet (14) and outlet (15) of the first cooling system and inlet (16) and outlet (17) of the second cooling system. Back wall (7) enables the reflux of the coolants.

Lower wall (2) of exchanger (1) comprises outlet (18) of the condensates.

Figure 2:
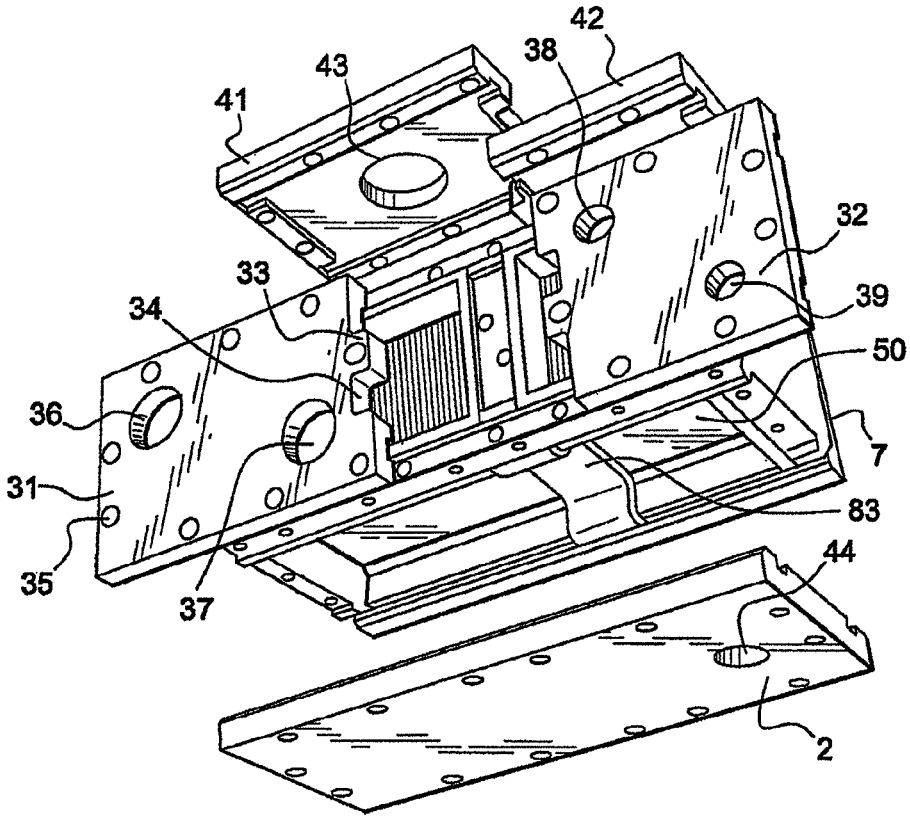
FIG. 2 is a schematic exploded perspective view of the exchanger of FIG. 1 in which the outer panels are shown separately.

The composition of the inside of exchanger (1) is shown in greater detail in FIG. 2 wherein the various outer walls are shown separate from centre of the exchanger. Thus upper wall (4) is shown detached and comprising two separate panels (41, 42) each of which is allocated to a section of the centre of the exchanger. Each plate comprises an opening (43) through which the inlet and outlet connection conduit of the fluid to be condensed passes. Similarly, frontal wall (3) also comprises two panels (31, 32) presenting, in the zones facing one another, cut-out sections (33, 34) enabling the two panels to be slotted together to provide effective fastening onto the centre of the exchanger via openings (35). The front wall can clearly also consist of a single panel without leaving the scope of the invention.

The back wall does not include an opening for the connection conduit to pass through and it is produced similarly to the frontal wall in two panels that are slotted together and fastened to the centre of the exchanger. Lower wall (2) on exchanger (1) consists of a single panel comprising an opening (44) intended for the connection conduit (18) of the condensates to pass through.

Each panel (31, 32) on frontal wall (3) also comprises openings (36, 37, 38, 39) intended to connect connection conduits (14, 15, 16, 17) to the cooling system. The centre of exchanger (50) is seen more clearly in FIG. 3 in which the outer walls are not shown.

More precisely, inner section (50) on the exchanger mainly comprises two welded-plate modules (52, 53) that are assembled by means of columns (55-58) along their aligned edges and separated from each other by an intermediary wall (59).

The design of each welded-plate module (52) is know in itself according to the principle disclosed in the applicant's patent EP 0 165 179. Briefly, such a module (52) comprises a set of corrugated plates welded together by connecting sections. Such a module (52) therefore comprises a first fluid system that opens onto the front and rear surfaces of the module shown in FIG. 3. A second fluid system, which in the present example is intended to collect the fluid to be condensed, passes through the exchanger from the upper surface of module (52) to the lower surface. More precisely, lower surface (67,70) of both modules (52, 53) opens into a free space the lower section of which is defined by lower outer wall (2).

Thus volume (63) defined between lower wall (2) and sections (61, 62) extending module (52) downwards define a section of the characteristic connecting chamber (66). Connecting chamber (66) therefore extends along the entire length of the exchanger and therefore connects lower surface (67) of first module (52), which constitutes the outlet of the system of fluid to be condensed in the first module, to lower surface (70) of second module (53) which constitutes the inlet of the system of fluid to be condensed in the new module.

Both modules (52, 53) are in mechanical contact with intermediary wall (59) via their lateral surfaces. The intermediary wall comprises a recess (72) intended to ensure the continuity of connecting chamber (66) along the length of the exchanger.

Figure 3:
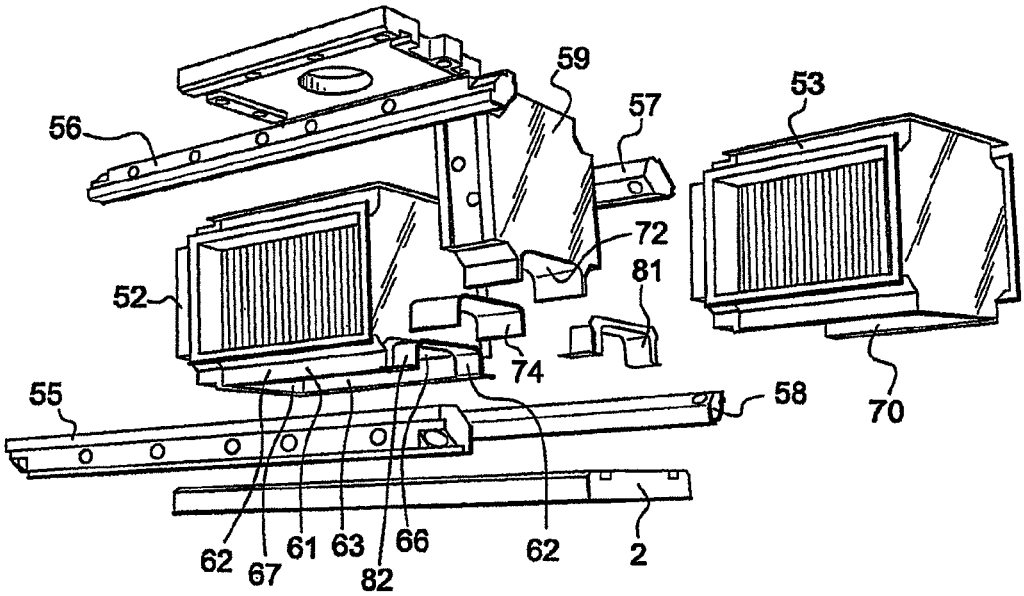
FIG. 3 is a schematic exploded perspective view of the inside of the exchanger in FIG. 1 in which the welded-plate modules are shown separately.

The internal surface of recess (72) has a connection plate (83) shown in FIG. 2 that constitutes a wall defining the connecting chamber between the two modules (52,53). As shown in FIG. 3, connection plate (83) is constituted by assembling two connecting sections (81,82) intended to be welded together. In a preferred embodiment shown in FIG. 4, each connecting section (81) comprises a flat section (85) intended to be welded to one of modules (52,53). Each connecting section (81,82), which is preferably produced in a single section, presents a central section in a reversed U shape (86) extended by feet (87).

According to another characteristic of the invention, each connecting section (81,82) of connection plate (83) presents expansion bellows (88) in the centre of central section (86) of each connecting section (81). Bellows (88) enables the said plate to be distorted in direction D which matches the flow of the fluid to be condensed within connecting chamber (66) and which therefore matches the direction defined between modules (52, 53). The expansion bellows may particularly be obtained by stamping.

The two sections (81,82) of the connection plate are each welded onto one of plate modules (52,53) before the modules are assembled. The two connecting sections are then welded together to constitute connection plate (83). To prevent any contamination from the welding, recess (72) receives a protection plate (74) in a general reversed U shape slotted between intermediary wall (59) and the two sections (81,82) of the connection plate. Protection plate (74), which is produced in the same high-grade material as connecting sections (81,82), is intended to isolate them from intermediary wall (59), which is produced in a lower grade material, when modules (52,53) are welded for assembly.

Figure 5:
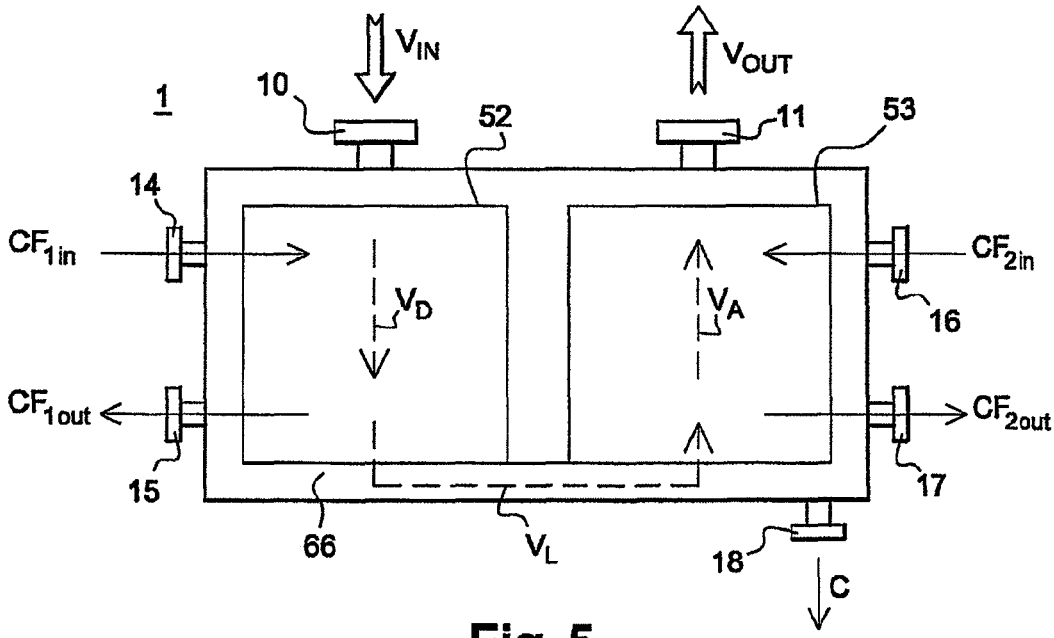
FIG. 5 is a diagrammatic view showing the operation of the exchanger in FIG. 1.

The operation of the exchanger thus described is shown in FIG. 5. Thus the fluid to be condensed V penetrates ($V_{IN}$) the exchanger and enters the first module of welded plates. The system of fluid to be condensed (V) inside the first module therefore flows through a first section $V_D$ shown by a descending arrow in first module (52). Through contact with first cooling system ($CF_1$) the fluid to be condensed is therefore separated from part of the condensed liquid in the first module, the first liquid flowing in connecting chamber (66) and then to the outlet of condensates (C).

The fluid containing matter to be condensed continues to flow in connecting chamber (66) according to arrow $V_L$ and penetrates second module (53) through which it passes in an ascending circuit shown by arrow $V_A$ inside the second module which is cooled by a cooling system $CF_2$ which may be, for example, glycol water. In second module (53) the fluid to be condensed ascends and therefore has reflux flow which improves mist elimination.

The invention enables different coolants to be advantageously selected to optimise the condensation phenomenon. The volumes and flow rates of the coolants can also be modified to optimise the thermal performance of the exchanger.

Part of the condensates therefore flow in the opposite direction to the fluid circulation to improve the efficiency of the condensation process. The additional part of condensates is also evacuated through outlet (18) used to eliminate condensates.

It should be noted that that there may be a greater number of welded-plate modules than the two shown in the previous figures in order to benefit, where appropriate, from a greater number of cooling systems.

Figure 4:
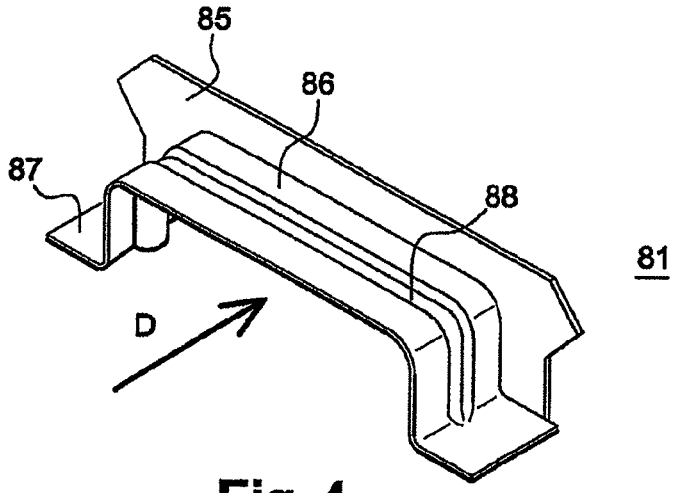
FIG. 4 is a schematic perspective view of an embodiment of a connection plate used to produce the connecting chamber.
Figure 6:
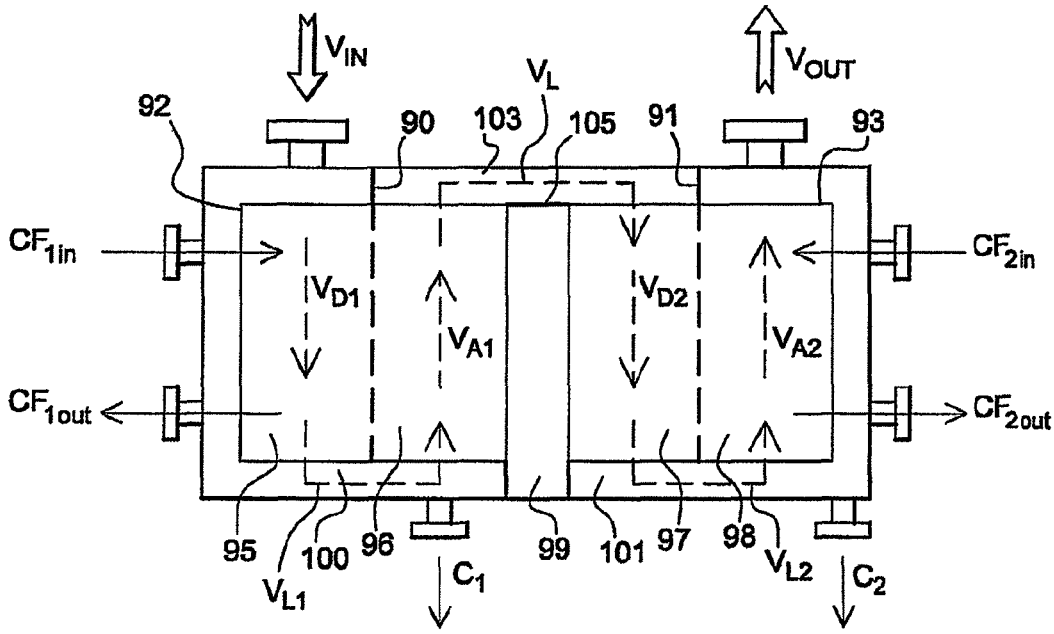
FIG. 6 is a diagrammatic view showing the operation of an alternative embodiment.

It is also possible, as shown in FIG. 6, to produce an exchanger characteristic of an alternative embodiment. In this example baffle plates (90, 91) are disposed in each of the welded-plate modules such that they divide each elementary module (92, 93) into two distinct zones (95, 96, 97, 98). In this example in first zone (95) of first module (92) the fluid to be condensed $V_{IN}$ flows in a descending flow $V_{D1}$ and ascends in second section (96) of the same module (92) in ascending flow $V_{A1}$. Intermediary wall (99) is extended downwards to define an open zone (100) enabling the fluid to be condensed $V_{L1}$ to flow from first section (95) to second section (96) in first module (92) while isolating open zone (101) from second module (93). The fluid system is extended by exiting via the upper section of first module (92) and opening into a connecting chamber (103) defined by baffle plate (90, 91) and a plate (105) which may be similar to the connection plate comprising two connecting sections (81,82), one of which is shown in FIG. 4.

The fluid system is then extended by a descending section $V_{D2}$ in first section (97) in second module (93), then a section $V_{D2}$ in connecting chamber (101) and finally by ascending section $V_{A2}$ in second section (98) in second module (93).

An exchanger is therefore obtained in which two mist-elimination phases with reflux flow ($V_{A1}$, $V_{A2}$) are created in each cooling system ($CF_1$, $CF_2$).

In this version condensates ($C_1$, $C_2$) can be collected independently, which is advantageous for specific applications such as the return of the condensates at two different levels in a distilling column.

As is apparent from the foregoing description, the exchanger according to the invention presents many advantages, particularly by combining a high level of efficiency in the condensation process with compactness that makes it easy to fit in many installations. Furthermore, such a condenser means the fluid to be condensed can be easily connected.

The industrial applications of this type of exchanger include condensation at the top of a distilling column or condensation of effluent from reactors used in fine chemistry or the pharmaceuticals industry.

The invention claimed is:

1. Condenser-type heat exchanger, comprising a housing surrounding at least two spaced apart modules of welded plates, each module comprising an independent cooling system, and a connecting chamber that connects the at least two modules in series such that direction in which fluid to be condensed flows through the modules is reversed when the fluid flow changes from a first module to a second module, and wherein the connecting chamber is formed by an outwardly facing surface of the first module, an outwardly facing surface of the second module, both surfaces being located on a same side of the exchanger, a connection plate connecting said surfaces, and at least one wall of the housing, wherein the surfaces are coplanar and the connection plate includes a wall extending between the surfaces, and wherein the connection plate includes a section elastically deformable in a direction of fluid flow between the modules.

2. Heat exchanger as claimed in claim 1, wherein temperature of a coolant in the second module is lower than temperature of coolant in the first module.

3. Heat exchanger as claimed in claim 1 wherein the connection plate comprises two connecting sections located between the modules and assembled together.

4. Heat exchanger as claimed in claim 1 wherein elastically deformable section comprises expansion bellows.

5. Heat exchanger as claimed in claim 1, wherein the first and second modules comprise different volumes.

6. Heat exchanger as claimed in claim 5, wherein volume of the second module through which the fluid to be condensed flows is smaller than volume of the first module.

7. Heat exchanger as claimed in claim 1, wherein at least one module includes a baffle plate separating flow of the fluid to be condensed in the at least one module into two segments in series directed in opposite directions.

8. Heat exchanger as claimed in claim 1, wherein the connection plate includes a central section having a reversed U-shape extended by feet.

* * * * *